United States Patent [19]

Lynch et al.

[11] 4,029,309

[45] June 14, 1977

[54] SET TRANSPORT AND STACKER

[75] Inventors: Thomas Lynch; Larry L. Leiter, both of Fairport, N.Y.

[73] Assignee: Xerox Corporation, Stamford, Conn.

[22] Filed: Oct. 29, 1975

[21] Appl. No.: 626,959

[52] U.S. Cl. ..... 270/53
[51] Int. Cl.² ..... B42B 2/00
[58] Field of Search ..... 270/37, 53, 58; 271/64, 271/173, 236, 238–239; 227/5–7, 19

[56] References Cited

UNITED STATES PATENTS

| | | | |
|---|---|---|---|
| 2,919,917 | 1/1960 | Worswick | 270/58 |
| 3,744,790 | 7/1973 | Hoffman | 270/58 |

*Primary Examiner*—Edgar S. Burr
*Assistant Examiner*—A. Heinz

[57] ABSTRACT

A sheet finishing apparatus for compiling individual sets of documents produced by a copy machine, transporting the compiled set of sheets to a stapler mechanism for stapling the compiled set, and transporting the stapled set to a stacker whereat a plurality of stapled sets may be stacked.

5 Claims, 3 Drawing Figures

SET TRANSPORT AND STACKER

BACKGROUND OF THE INVENTION

With the advent of high speed copy reproduction machines, it was soon recognized that the machine operators could not perform their normal functions at a speed commensurate with the speed of the copy machine, resulting in copy output from the machines much lower than the actual printing speed of the machine. To minimize operator involvement and allow maximum output from the printing machine, automatic document handlers were developed to circulate documents to be copied to the platen of a copy machine. These automatic document handlers along with an automatic copy sheet output collators, reduce the operator tasks to the initial programming of the copy machine, loading of the original document set, paper loading, and collator unloading. However, it has been found that in producing a large quantity of small sets of documents, the machine operator cannot keep up with the output of the machine, resulting in machine down time as the collator is being emptied to allow continuation of the copy run. To overcome these difficulties, a sheet collating machine of the type disclosed in U.S. Pat. No. 3,708,160, which is adapted to collate, staple, and eject the stapled sets may be utilized. However, machines of this type of necessity require extensive floor space and are quite complex and expensive.

It is therefore an object of the present invention to provide a sheet compiler, transport, stapler, stacker adapted to receive pre-collated output from a copy machine and perform the desired finishing operations thereon so that the operator need only remove the stapled sets from the stacker during or after the copy run.

SUMMARY OF THE INVENTION

A sheet finishing apparatus for compiling, transporting, stapling and stacking pre-collated document sets produced by a copy machine including a copy receiving tray adapted to receive sheets seriatim from a copy machine and compiler means disposed in the copy receiving tray adapted to bottom and side register the sheets received therein. Clamp means adapted for movement along a predetermined path are positioned adjacent the bottom of the receiving tray to receive and clamp the completed document set and thereafter move the clamped document set to a stapler station whereat the clamped set may be stapled if desired, the set thereafter being moved to an ejector station whereat the clamp means are released and the completed document set is ejected into a set stacker.

DESCRIPTION OF THE PREFERRED EMBODIMENT

Figure 1:
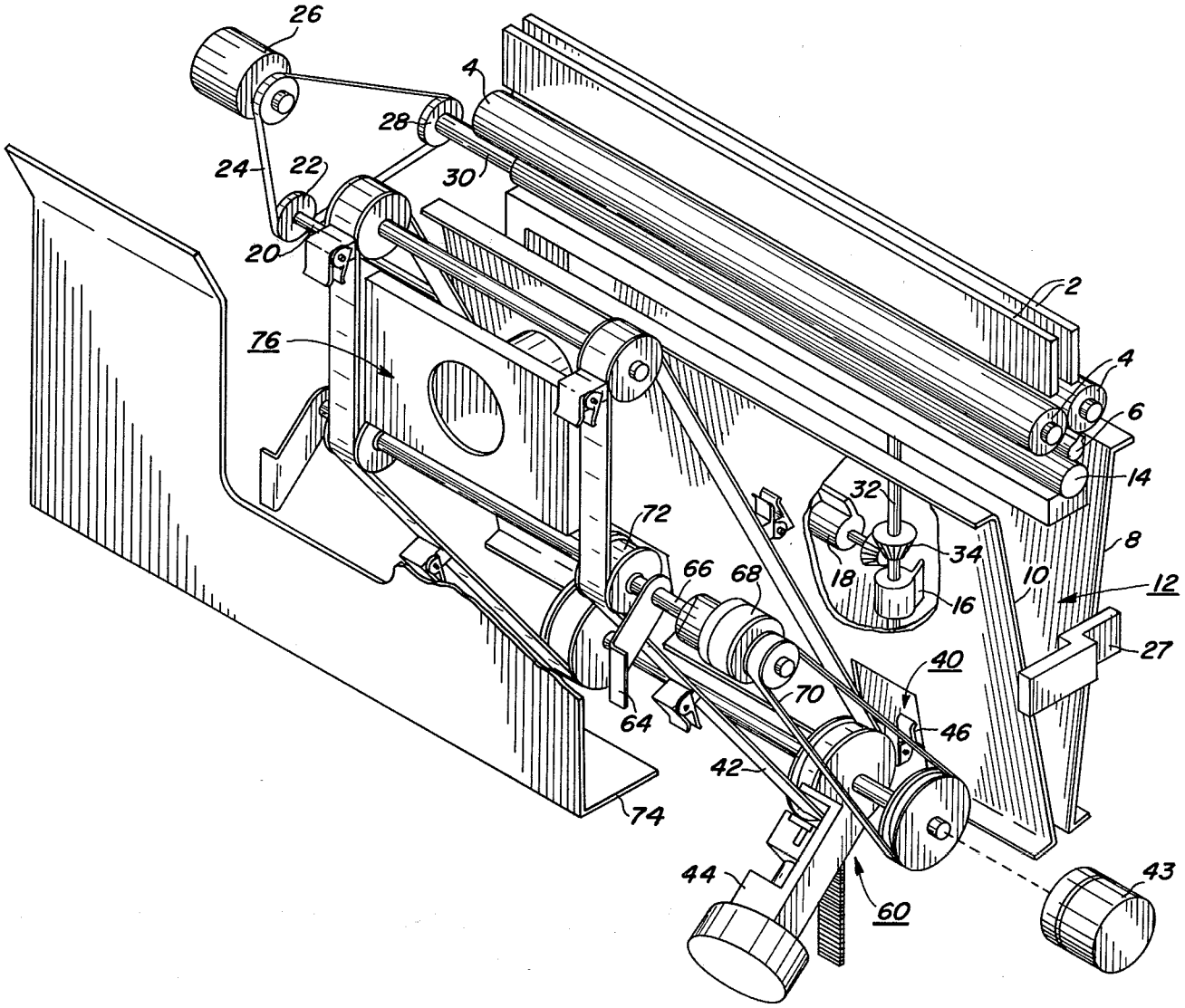
FIG. 1 is an isometric, schematic view of the compiler, transport, stapler, stacker of the present invention with portions removed to illustrate mechanical components thereof.

Referring to FIG. 1 of the drawings, there is illustrated a finishing apparatus including stationary sheet guides 2 and feed rolls 4 adapted to receive collated copy output from a copy machine such as a xerographic processor. The sheets fed downwardly by rolls 4 are deflected by a gate member 6 toward a back wall 8 or a front wall 10 of a vertical compiler bin 12 for reasons to be hereinafter explained. With the gate 6 in the position illustrated in FIG. 2, the sheets are directed against the back wall 8 of bin 12. Immediately downstream from gate 6 there is provided an elongated rotating roller 14 over which the sheets pass to enter bin 12. The rotation and size of the roller are selected to maintain the previously delivered sheets inclined at an angle so that the next incoming sheet can enter without striking the trailing edges of the sheet already delivered to the bin. As the sheets enter the bin, they are contacted by a pair of compiler paddles 16 adapted to side register the sheets and a pair of bottom compiler paddles 18 adapted to bottom register the sheets in bin 12. Paddles 18 are mounted on a horizontal drive shaft 20 which is driven through a suitable pulley 22 and belt 24 by reversible motor 26 which is also adapted to rotate roller 14 through means of belt 24 and a pulley 28 mounted on the drive shaft 30 of roller 14. Paddles 16 are mounted on vertical drive shafts 32 which are driven through suitable bevel gears 34 by shaft 20. Flexible extensions 33 on shafts 32 are provided to maintain the bottom edges of the sheets closely adjacent each other to assure adequate space in the narrowed lower portion of the bin for all of the sheets in the set being compiled therein. The paddles 16 and 18 are located on their respective shafts to provide for alternate contact of the sheets thereby. This arrangement provides a much more effective compiling action than has heretofore been possible with paddle wheel compilers wherein the sheet is continuously acted upon to drive the sheets in two directions simultaneously. With the alternating action of the paddle wheels a number of benefits are obtained. Each sheet is registered and re-registered a number of times until the next sheet covers the previous sheet. Sheet bounce normally encountered when the sheet is driven against the side register in normal paddle type compilers is obviated due to the contact of the sheet by the alternate paddles. Reverse migration of the sheets due to the constant vibratory effect generated by the paddles is controlled since one or the other sets of paddles is substantially always in contact with the sheet. Sheets cannot skew because they are acted upon either straight down or straight to the side alternately rather than angularly and also in that there are a number of paddles widely spaced on the sheet. Depending on the characteristics of the particular compiler, a differential in the sideways or downward motion of the sheet can be achieved by varying the width or the number of the side acting or down acting paddles. It should be understood that each sideward paddle must have a downward paddle closely adjacent thereto in order to repeatedly beat the incoming sheets against the side of the compiler to prevent subsequent sheets from striking the top edge of the sideward paddle as it is rotated around into contact with the sheet.

The alternating paddles provide a substantial improvement in compilation efficiency as contrasted to single paddles mounted at an angle which appear to be capable of only registering the sheets once. If the sheets bounce back from a side stop, as is common with angled, single paddles, the paddles cannot urge them aside once again because of the friction of the sheet against the bottom stops which prevents sideways movement of the sheets since the paddle is constantly pushing the sheets simultaneously to the bottom and providing too great a friction thereagainst. Further, angled, single paddles are also found to introduce skew in the sheets. Attempting to use two angled paddles to overcome the skew problem appears to cancel out the sideways motion of the sheets completely. Thus, the alternating action of separate sideways and downwards acting paddles provides a dramatic improvement in sheet compiling.

Figure 2:
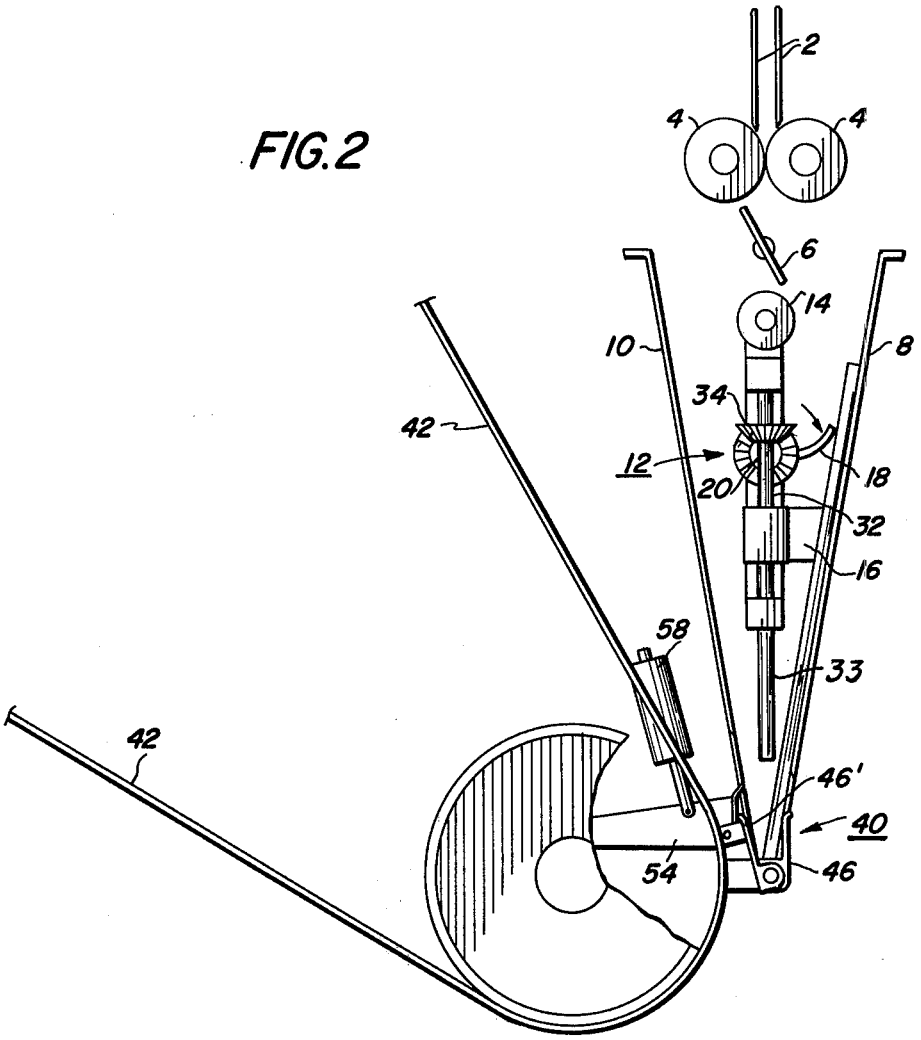
FIG. 2 is a side view of the compiler portion of the sheet finishing apparatus of FIG. 1; and, FIG. 3 is an enlarged view of the clamping mechanism utilized for clamping the completed copy sets and transporting the completed sets from the compiler.

As stated heretofore, sheets may be directed against the back wall 8 or the front wall 10 of the vertical compiler bin. This versatility is desirable to allow production of copies by the reproduction machine in proper page order, i.e., 1, 2, 3, etc. or, if for some reason such as recirculation of the original set of documents, in the reverse order, resulting in the pages being presented to the compiler in the reverse order, i.e., 10, 9, 8, etc. In the event that the sheets are presented to the compiler in proper order, i.e., 1, 2, 3, with the printed side facing the right or side 8 of the bin as illustrated in FIG. 2, the gate 6 would be positioned as illustrated in FIG. 2 to place page 1 against back wall 8 followed by page 2, page 3, etc. to provide a completed set having the proper pagination. In the event that the copies are being received in the compiler in reverse order, the gate would be repositioned to direct the incoming sheets against front wall 10 of the compiler. Thus, assuming a 10 page set, page 10 would be received and placed against wall 10 followed by page 9, page 8, etc. to provide a completed compiled set therein again having the proper pagination. It should be understood that when the gate is in the position opposite that shown in FIG. 2, motor 26 would be operated in the reverse direction to operate roller 14 and paddles 16 and 18 in the opposite direction since the sheets are being received on the opposite side thereof. If desired, a stepped side register stop 27 may be provided so that sets compiled against back wall 8 are slightly offset from sets compiled against front wall 10, this offset would then be maintained throughout the path of travel of the completed set to the stacking tray whereat the completed sets would be delivered offset to simplify separation of individual sets in the stack of sets. This offset arrangement is particularly advantageous if the sets are not be stapled prior to their delivery to a stacker station.

As the last sheet of a set comes to its stop in the compiler, the set is taken away through the bottom of the compiler by the action of gripping clamps 40 mounted on transport belts 42 which transport the clamped set to the stapler mechanism 44 for stapling thereat.

Figure 3:
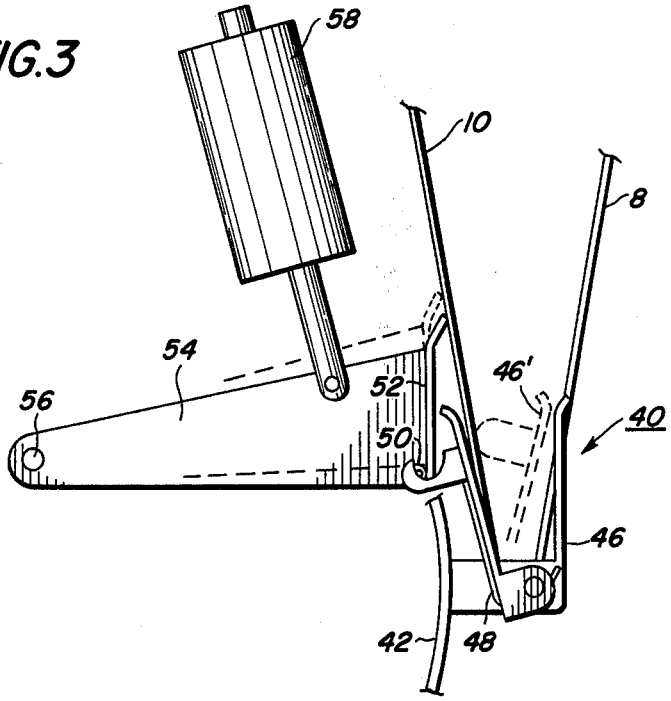

The set transport illustrated utilizes 4 pairs of clamps 40 secured to the belts 42. The jaws 46 of the clamps are biased toward a closed position by suitable springs 48. As the belts 42 are indexed by motor 43 to move a set of clamps into position as illustrated in FIG. 2 to mate with the bottom opening of the compiler for receipt of sheets therein, the jaws are forced open by the mechanism illustrated in FIG. 3. As the clamps 40 are moved into position, cam followers 50, associated with movable jaws 46' of clamps 40 are contacted by cam surfaces 52 mounted on suitable arms 54 which are pivoted at 56 to the frame of the compiler mechanism. The action of the followers 50 against the cam surfaces 52 cause the movable jaws 46' to be forced open against the action of springs 48.

When a set is complete in the compiler and the last sheet has been registered to the reference edges, solenoids 58 are actuated to rotate arms 54 about pivots 56 to move cam surfaces 52 out of engagement with followers 50 and allow the spring loaded jaws of the clamps to close upon the set and firmly grasp all sheets together in registration. Following this, the belts 42 are indexed to move the next set of clamps thereon to the bottom of the compiler for receiving the next set of sheets from the reproduction machine while the clamped set is being indexed to a stapler station 60 whereat the compiled set may be stapled or stitched by a suitable mechanism 44. If desired, the speed of motor 43 may be variable to provide a slow start up of the belts 42 and provide a soft start for each indexing cycle to prevent pull-out of the clamped sets from the clamps 40. As an alternative, suitable mechanical linkages could be utilized such as a Whitworth link drive to provide a variable speed for the belts 42 and provide a slow start therefor.

The compiled sets may be stapled at the stapler station by any suitable stapling mechanism such as a "Swingline" Model 6800 manufactured by the Swingline Division of Swingline, Inc., 32-00 Skillman Avenue, Long Island City, New York. As the subsequent sheets are being compiled in the compiler section, the set of copies at the stapler station is stapled. When the subsequent set is completed in the compiler and clamped therein, the belts 42 would again be indexed to move the subsequent set to the stapler station while presenting the following set of clamps at the bottom of the compiler for receiving the next set.

It should be understood that it is not necessary to staple the sets if it is desired to assemble the sets for subsequent operations such as binding. As stated heretofore, the offset feature allows unstapled sets to be easily separated from each other in the stacker for subsequent processing.

The stapled set is moved to the stacker station whereat there is provided kicker arms 64 mounted on a shaft 66 which is driven through a suitable clutch 68 and belt 70 from the drive shaft for belts 42. Idler pulleys 72 may be mounted on shaft 66 to guide belts 42 therearound. Upon receipt of a completed set in the stacking area, the clutch 68 is momentarily energized to move the kicker arms into engagement with the stapled set and force the trailing edge of the stack into the stack tray 74 and clear the area opposite arms 64 for receipt of the next stapled set. Simultaneously therewith, the clamps holding the top edge of the stapled set are released by a suitable mechanism, for example, a movable cam surface engageable with cam followers 50, and a stack pusher 76 would be actuated to push the upper portion of the stapled set into the stack tray 74. The pusher mechanism may take any number of forms. For simplicity, the pusher is illustrated as a solenoid mechanism adapted for movement against the back side of the set to push the set into the tray 74 and maintain the set therein, the pusher being retracted during the indexing cycle to provide space opposite thereto for receipt of the succeeding stapled set. The back wall of tray 74 may be movable toward and away from the pusher mechanism and be biased toward the pusher mechanism to maintain stacked sheets therebetween, the stacked sets and back wall of tray 74 being continuously displaced away from the finishing apparatus each time the apparatus is indexed and the pusher thereafter activated to clear a space for receipt of subsequent sets.

It can be seen from the foregoing that a very compact and versatile finishing station is provided which enables compiling sheets in the proper page order irrespective of the order in which they are produced by a reproduction machine, transported to a stapler mechanism whereat the compiled sets are stapled, and then transported to a stacking station whereat the stapled sets are stacked for subsequent removal by the machine operator.

While we have described a preferred embodiment of our invention, it should be understood that the invention is not limited thereto, but may be otherwise embodied within the scope of the following claims.

What is claimed is:

1. A sheet finishing apparatus including a compiler comprising opposed substantially vertical side walls for stacking sheets thereon, the top portion of said walls forming an entrance therebetween for directing sheets downwardly between said walls;

a movable sheet deflector disposed midway between said opposed side walls at the entrance thereof, movement of said deflector to a first position causing the sheets supplied to the compiler to be deposited against one of said opposed walls, movement of said deflector to a second position causing the sheets supplied to the compiler to be deposited against the other of said opposed walls to enable compiling of the sheets received therein against either wall, depending on the position of said deflector, first and second rotary paddle means disposed centrally between said opposed side walls, said first paddle means being adapted to urge sheets received between said first paddle means and said sides in a downward direction, said second paddle means being oriented 90° from said first paddle means; and, drive means adapted to rotate said paddle means in a first direction when said deflector is in said first position, said drive means being reversible to rotate said paddle means in a reverse direction when said deflector is in said second position to urge the sheets in the same direction irrespective of the side wall of the compiler against which the sheets are deposited.

2. A sheet finishing apparatus including a compiler comprising opposed substantially vertical side walls for stacking sheets thereon, the top portion of said walls forming an entrance therebetween for directing sheets downwardly between said walls; and, a movable sheet deflector disposed midway between said opposed side walls at the entrance thereof, movement of said deflector to a first position causing the sheets supplied to the compiler to be deposited against one of said opposed walls, movement of said deflector to a second position causing the sheets supplied to the compiler to be deposited against the other of said opposed walls to enable compiling of the sheets received therein against either wall, depending on the position of said deflector, binding means adapted to receive sets of copy sheets from said compiler and secure the sheets of each set together;

stacking means adapted to receive sets of copy sheets from said binding means for collecting and retaining the completed sets therein; and transport means including endless conveyor means having a plurality of clamps thereon adapted to clamp the compiled sets and transport the clamped sets from said compiler to said binding means and from said binding means to said stacking means.

3. A sheet finishing apparatus according to claim 2 further including cam means adapted for cooperation with said clamps to cam said clamps open as said endless conveyor means moves said clamps into position at the bottom of said compiler to receive sheets therein;

spring means adapted to bias said clamps toward a closed position against the action of said cam means; and solenoid means adapted to move said cam means away from said clamps to allow said spring means to close said clamps on the sheets collected in said compiler to enable subsequent movement of said compiled sheets to said binding means upon movement of said endless conveyor means.

4. A sheet finishing apparatus including a compiler comprising opposed substantially vertical side walls for stacking sheets thereon, the top portion of said walls forming an entrance therebetween for directing sheets downwardly between said walls; and, a movable sheet deflector disposed midway between said opposed side walls at the entrance thereof, movement of said deflector to a first position causing the sheets supplied to the compiler to be deposited against one of said opposed walls, movement of said deflector to a second position causing the sheets supplied to the compiler to be deposited against the other of said opposed walls to enable compiling of the sheets received therein against either wall, depending on the position of said deflector, bottom edge registration means;

a first and a second side edge registration means, said first side edge registration means being offset from said second side edge registration means; and, sheet urging means adapted to urge sheets received in said compiler against said bottom edge registration means and said first side edge registration means when said deflector is in said first position and to urge sheets received in said compiler against said bottom edge registration means and said second side edge registration means when said deflector is in said second position to alternatively offset the sets of sheets relative to each other.

5. A sheet finishing apparatus according to claim 4 further including:

stacking means adapted to receive offset sets of copy sheets from said compiler for collecting and retaining the completed sets therein; and transport means including endless conveyor means having a plurality of clamps thereon adapted to clamp the compiled sets, said clamps forming said bottom edge registration means, said transport being adapted to transport the offset clamped sets from said compiler to said stacking means for stacking the sets in an offset manner therein.

* * * * *